United States Patent [19]

Molewyk et al.

[11] 4,368,715

[45] Jan. 18, 1983

[54] FUEL BURNER FOR HEATING INTERNAL COMBUSTION ENGINE INTAKE AIR

[75] Inventors: Terry L. Molewyk; Joseph M. Johnson, both of Nashville, Ind.

[73] Assignee: Cummins Engine Company, Inc., Columbus, Ind.

[21] Appl. No.: 221,769

[22] Filed: Dec. 31, 1980

[51] Int. Cl.[3] ..... F02M 31/00

[52] U.S. Cl. ..... 123/550; 123/549; 123/179 H; 123/145 A; 219/205; 219/523; 219/540

[58] Field of Search ..... 123/179 H, 145 A, 145 R, 123/549, 550; 431/11, 208; 219/205, 206, 207, 302, 305, 315, 523, 530, 536, 540

[56] References Cited

U.S. PATENT DOCUMENTS

| | | | |
|---|---|---|---|
| 2,487,924 | 11/1949 | Fiedler | 219/205 |
| 2,886,688 | 5/1959 | Cooper | 219/206 |
| 3,937,923 | 2/1976 | Smith | 219/523 |
| 3,977,376 | 8/1976 | Reid et al. | 123/179 H |
| 4,131,785 | 12/1978 | Shutt | 219/540 |
| 4,285,307 | 8/1981 | Steinke | 123/179 H |

FOREIGN PATENT DOCUMENTS

| | | | |
|---|---|---|---|
| 451452 | 8/1936 | United Kingdom | 431/208 |
| 666997 | 2/1952 | United Kingdom | 123/179 H |
| 574350 | 12/1975 | U.S.S.R. | 123/179 H |

*Primary Examiner*—P. S. Lall

*Attorney, Agent, or Firm*—Sixbey, Friedman & Leedom

[57] ABSTRACT

A burner assembly (18) for heating the intake air of an internal combustion engine (2) including a burner housing (32) containing a fuel passage (52, 66, 70, 72) and a glow plug (87) for heating the burner housing (32) upon start up of the burner to melt fuel wax deposits in the fuel passage (52, 66, 70, 72). The glow plug (87) includes a metal sheath (88) designed normally to contact air when energized at a rated level. The burner housing (32) includes a cavity (86) shaped to receive the glow plug (87) with a minimal clearance (a) large enough to prevent interference during assembly but small enough to allow metal-to-metal heat transfer into the housing (32) when the glow plug (87) is energized at twice its rated level. The burner assembly (18) is further characterized by a solenoid (82) operated valve (78) arranged to cut off the flow of fuel in housing (32) in response to an electrical control signal and by fuel flow passages (44', 52, 66, 70, 72) positioned as close as possible to the glow plug (87) to promote rapid melting of wax deposits within the flow passages (44', 52, 66, 70, 72).

17 Claims, 9 Drawing Figures

FIG. 4.
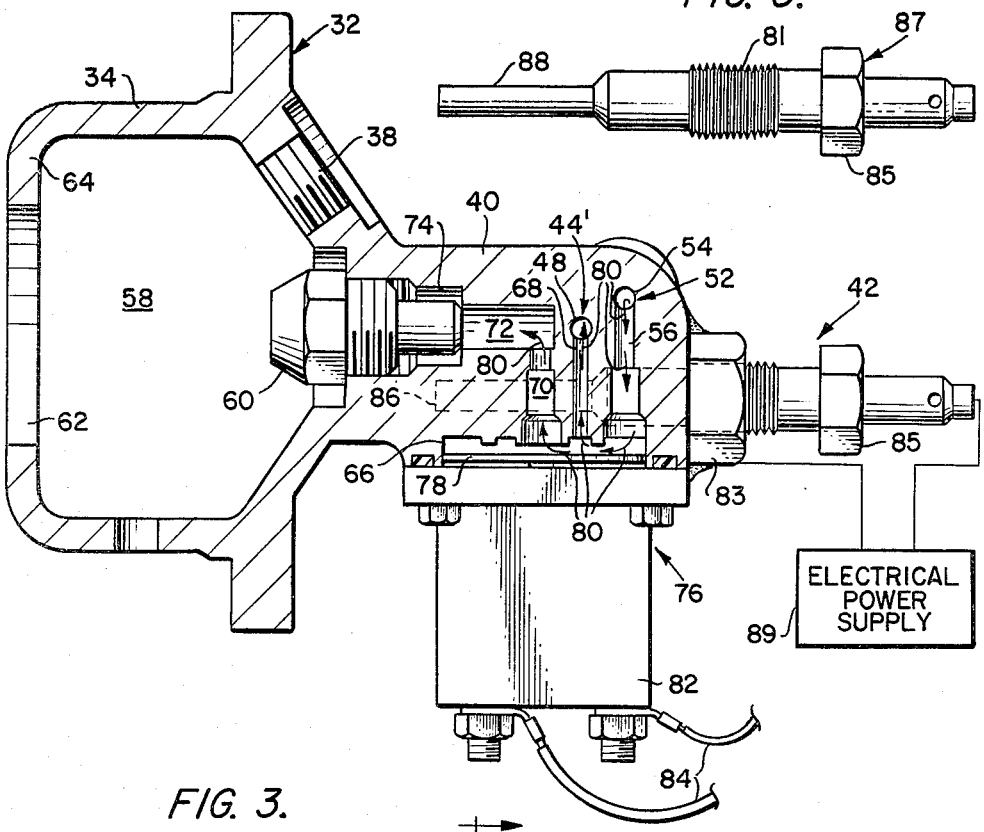
FIG. 5.
FIG. 3.
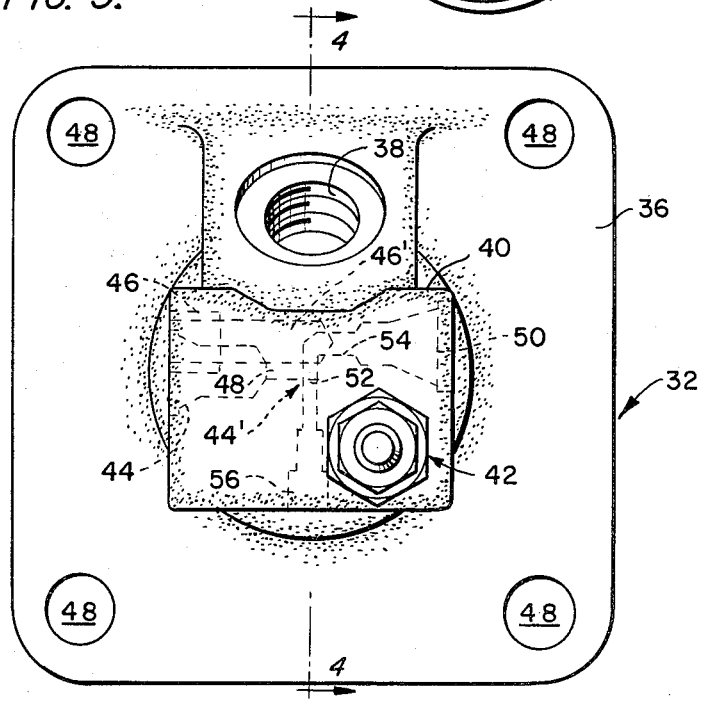

FUEL BURNER FOR HEATING INTERNAL COMBUSTION ENGINE INTAKE AIR

DESCRIPTION

1. Technical Field

This invention relates to fuel burners such as used for heating the intake air of an internal combustion engine of the type disclosed in U.S. application Ser. No. 959,650 filed Nov. 13, 1978, now abandoned assigned to the same assignee as the subject invention.

2. Background Art

In internal combustion engines of the compression ignition type, intake air heaters have long been used as a combustion aid to promote fast starts and to help control white smoke emissions. Such heaters generally take the form of a fuel burner mounted on the intake manifold of the engine such that combustion products exiting from the burner are directed through the intake manifold to the inlet ports of the cylinders. These burner generated combustion products mix with and heat the primary combustion air passing through the intake manifold. One example of an intake air heater of the fuel burner type is disclosed in U.S. Pat. No. 3,687,122, assigned to the same assignee as this invention. This burner has proven to be particularly successful in achieving rapid ignition and complete combustion of injected fuel to effect prompt starting of the engine and early elimination of white smoke.

One impediment to even more prompt and reliable operation of fuel burners has been the problem of wax crystal formation in the fuel passages leading to the combustion zone of the burner. In particular, internal combustion engines, such as vehicle engines, are often subjected to cold ambient environments under which certain fuels, such as No. 2 diesel engine fuel, will tend to develop wax crystal deposits. The small diameter fuel flow passages normally formed in the housing of a typical intake air fuel burner is particularly susceptible to this problem. While a momentary delay in fuel flow commencement may be acceptable in some applications of fuel burners, even the slightest delay can have a significant impact on the effectiveness of a burner used to heat the intake air of an internal combustion engine during start up.

Various techniques have been developed to deal with the problem of fuel line clogging due to wax deposits induced by low temperatures including the use of a resistance type electrical glow plug placed in heat conducting relationship with the burner's fuel line such as illustrated in U.S. Reissue Pat. No. 25,970, issued Mar. 1, 1966. Glow plugs are normally constructed with a threaded base and have an electrical resistance element surrounded by a metallic sheath. Each glow plug design is normally assigned a rated level of energization equal to the maximum safe level of electrical energization above which the plug will tend to overheat and fail prematurely. The rated level of energization will, of course, depend, in part, on the manner in which the plug is designed to be used. If the plug is designed for contact of the metallic sheath with the surrounding air, the rated level will be lower than would be the rated level of a plug whose sheath is designed for contact with material, such as metal, which has a greater capacity for heat transfer than does air. Plugs designed for metal to metal contact are, however, more expensive to manufacture since the dimensions of the metal sheath must be carefully controlled to permit non-destructive assembly but yet insure adequate contact. Examples of specialized types of glow plugs are illustrated in U.S. Pat. Nos. 3,689,195, issued Sept. 5, 1972, and 3,718,425, issued Feb. 27, 1973.

The desirability of heating fuel prior to burning in an internal combustion engine is well known as disclosed in U.S. Pat. No. 3,353,520, issued Nov. 21, 1976. This expedient also appears to have been employed in intake air fuel burner assemblies as illustrated in FIG. 7 of U.S. Pat. No. 4,027,642, issued June 7, 1977. However, no practical design for an electrically heated intake air fuel burner has been disclosed in the prior art which insures rapid and reliable response while permitting manufacture at reasonable cost.

DISCLOSURE OF THE INVENTION

The basic object of this invention is to overcome the deficiencies of the prior art as listed above by providing an intake air heater assembly designed to provide immediate and reliable operation at low ambient temperatures.

A more specific object of this invention is to provide an intake air heater assembly for an internal combustion engine including an electric resistance heat generating means for melting wax deposits in the fuel flow passages contained within the burner housing.

Still another object of the subject invention is to provide a fuel burner designed to receive an electric resistance glow plug for metling wax deposits wherein the glow plug includes a metallic sheath arranged for direct contact with the burner housing to permit metal-to-metal heat transfer between the glow plug and the burner housing.

Still another object of the subject invention is to provide a burner assembly including a heat generating means for melting wax deposits in the fuel supply passage used to feed fuel to the burner assembly wherein the heat generating means is operated at approximately twice its rated level of energization to cause faster melting of the wax deposits.

A still more specific object of the subject invention is to provide a fuel burner assembly including a housing containing a cavity for receiving an electrical resistance heating glow plug having an outer metallic sheath normally arranged for radiating heat into air wherein the cavity is formed to provide a slight clearance between the cavity walls and the metallic sheath of the heat generating means when the burner is assembled but which expands into metal-to-metal contact upon initial energization of the glow plug.

Yet another object of the subject invention is to provide a fuel burner assembly including a cut-off valve and housing containing a recirculating fuel flow passage and heat generating means wherein the valve may be opened to permit free flow of fuel to the burner and to return a portion of the fuel to the source. When the valve is closed, fuel flow to the burner and back to the fuel source is cut off. The housing is shaped to position the flow passages and the valve as close as possible to the heat generating means.

All of the objects referred to above are achieved by the provision of a heating device for heating the intake air of a internal combustion engine including a burner housing containing a fuel passage and a glow plug received in a housing cavity of slightly larger dimension than the glow plug, whereby energization of the glow plug causes expansion thereof into contact with the interior surface of the housing cavity to promote heat transfer into the housing. The glow plug includes a metallic sheath which is designed normally to contact air but which expands upon energization to engage directly the housing to allow a level of energization substantially above the rated level without producing premature failure. The flow passage is arranged to allow for a recirculating pattern of fuel flow including an L-shaped supply branch and an L-shaped drain branch positioned immediately adjacent the housing cavity which receives the flow plug. During periods in which the heating device is not in use, wax deposits will tend to form in the flow passage of the housing. Energization of the glow plug at twice its rated valve causes an extremely rapid rise in temperature which insures that the wax deposits will not interfer with prompt start up of the heater. The flow passage further includes a flow cavity opening into the bottom surface of the housing and communicating with vertical leg portions of the L-shaped supply branch and the L-shaped drain branch. A vertically oriented central branch extends upwardly from the flow cavity to supply fuel to a generally horizontally oriented nozzle which also receives air through an air supply passage to atomize the fuel into a predetermined spray pattern. The vertically oriented legs of the supply and drain branches and the central branch are all arranged in the same place which is generally parallel to the longitudinal axis of the flow plug in order to position the fuel passage as close as possible to the source of heat provided by the glow plug. The flow cavity is arranged to receive a solenoid operated valve member which is positioned for movement between a first position in which fuel flow is cut off and a second position in which free fuel flow is permitted. The flow cavity is also positioned close to the heat generating means to permit wax deposits in the flow cavity to be quickly melted upon energization of the burner.

Still other and more specific objects of this invention will appear from the following brief description of the drawings and the best mode for carrying out the invention.

BRIEF DESCRIPTION OF THE DRAWINGS

FIG. 3 is an end elevation view of the fuel burner illustrated in FIG. 2;

FIG. 4 is a cross-sectional view of the fuel burner taken along lines 4—4 of FIG. 3 in combination with a side elevational view of a valve operator;

FIG. 5 is a side elevational view of a glow plug for use in the fuel burner illustrated in FIGS. 1-4;

BEST MODE FOR CARRYING OUT THE INVENTION

Figure 1:
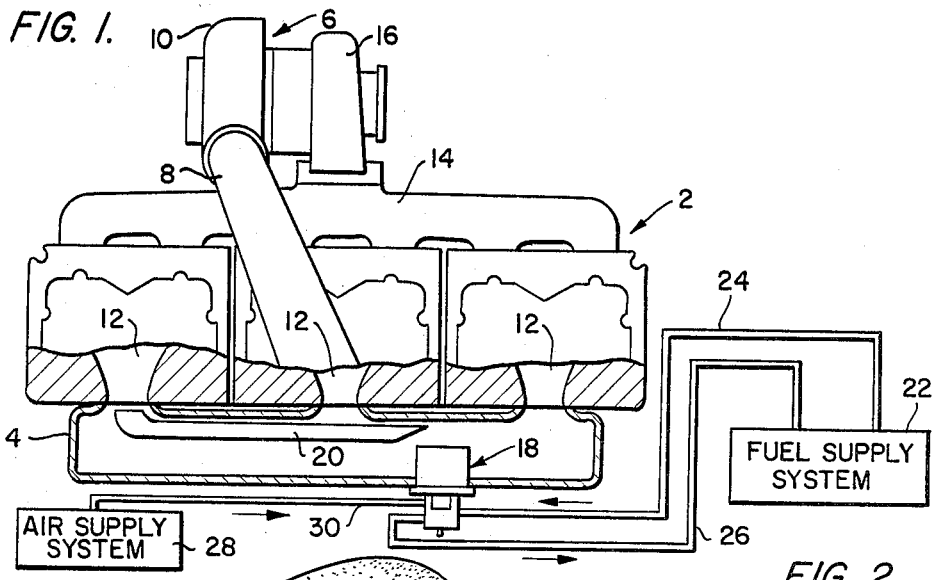
FIG. 1 is a partially cutaway top elevational view of an internal combustion engine equipped with a fuel burner designed in accordance with the subject invention for use as an intake air heater device.

The subject invention relates to a fuel burner adapted for use as an intake air heating device for an internal combustion engine. The burner is characterized by a very fast starting capability yet relatively simple design which makes the burner economic to manufacture and reliable in operation. For a clear understanding of the subject invention, reference is initially made to FIG. 1 in which an internal combustion engine 2 of the compression ignition type is illustrated including an intake manifold 4 arranged to receive intake air from a turbocharger 6. An air passage 8 is connected at one end to the intake manifold 4 and at the other end to the compressor stage 10 of the turbocharger 6. The intake manifold 4 is designed to distribute air received from the turbocharger 6 to each of the input ports 12 leading to the respective engine cylinders, not illustrated.

The details of operation of a engine of the type illustrated in FIG. 1 are well known. Briefly, however, the diesel engine compresses air in cylinders by pistons (both not shown) so that temperatures are high enough to spontaneously ignite fuel injected into each cylinder at the top of the compression stroke. The resulting explosion drives the pistons downward and produces a rotary output to an engine crankshaft (also not shown). The exhaust gases are expelled from the engine through an exhaust manifold 14 which directs the gases through a turbine stage 16 of the turbocharger 6. The turbine stage 16 is mechanically linked with the compressor stage 10 to provide air under pressure to the intake manifold 4. When ambient air temperatures are low, a diesel engine requires assistance, such as by heating the intake air, to enable the engine to start. In addition, modern turbocharged and aftercooled engines may also require heating of intake air during certain operating conditions to avoid the occurrence of white smoke and other undesirable exhaust emissions.

One way to heat effectively the intake air of a compression ignition engine is to provide an auxiliary fuel burner in the intake manifold of the engine. The subject invention is directed to a fuel burner designed for this purpose. Before describing the details of the subject burner design, however, reference will continue to be made to FIG. 1 to illustrate how such a fuel burner, designated as burner assembly 18, would operate in the illustrated compression ignition engine 2. In order to distribute the heating effect of the flame produced by burner 18, a distribution tube 20 may be provided to insure that heated air is evenly distributed among the inlet ports 12. Fuel may be supplied to burner 18 by a fuel supply system 22 of the recirculating type. In particular, fuel supply system 22 includes a supply branch 24 for providing a flow of fuel in excess of that actually consumed by the burner and a return conduit 26 for returning the excess fuel to the engine fuel tank (not illustrated). Fuel burner 18 may employ a fuel atomizing nozzle (not illustrated) to which air is supplied from an air supply system 28 connected to the fuel burner via an air supply conduit 30.

Figure 2:
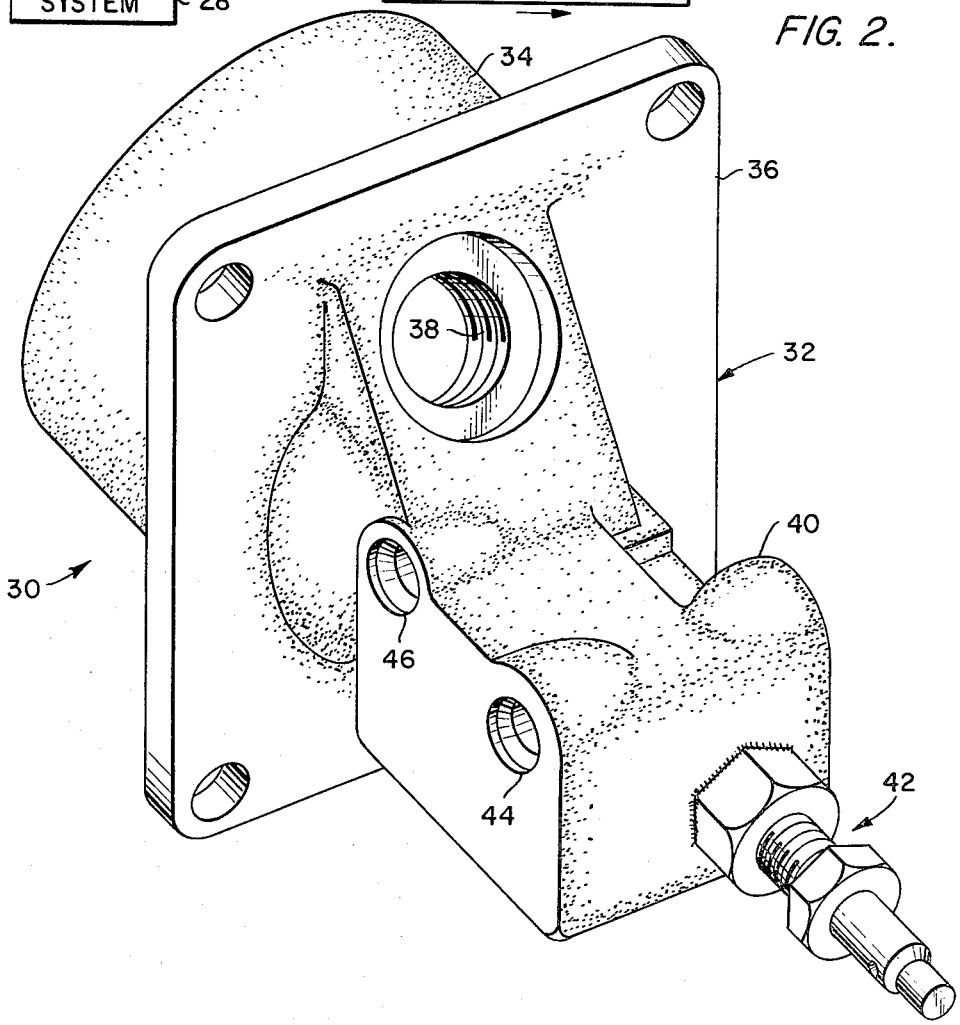
FIG. 2 is a perspective view of the fuel burner illustrated in FIG. 1.

Referring now to FIG. 2, fuel burner 18 is illustrated in a perspective view wherein the burner includes a housing 32 including a generally cylindrical wall portion 34 containing the combustion chamber (not illustrated), one end of which includes a combustion gas exit port adapted to communicate with the interior of the intake manifold 4 of FIG. 1. Mounting means in the form of a generally planar flange 36 is integrally formed with housing 32 for mounting the housing on the intake manifold 4 in a position to cause the combustion gas exit port of the fuel burner to communicate with the intake manifold. Threaded opening 38, communicating with the interior of the combustion chamber, is adapted to receive a spark plug type ignitor (not illustrated) for initiating combustion within the combustion chamber. Housing 32 further includes a second portion 40 containing the fuel and air flow passages as well as a threaded cavity for receiving an atomizer nozzle which will be described in greater detail hereinbelow. Second portion 40 also contains a cavity for receiving an electrical heat generating means 42 for generating sufficient heat upon a predetermined level of electrical energization to melt wax deposits formed in the fuel supply passages contained within burner housing 32. FIG. 2 specifically shows a fuel drain port 44 for connection with drain conduit 26 illustrated in FIG. 1. An air supply port 46 is also illustrated for connection with air supply conduit 30 (FIG. 1) for supplying air required by the fuel burner 30.

Reference is now made to FIG. 3 which discloses an end elevational view of the fuel burner of FIG. 2 wherein corresponding elements are identified by the same numerals used in FIG. 2. In particular, planar flange 36 can be seen as having a generally square outer configuration and contains four bolt receiving cavities 48 for attaching the burner housing to the intake manifold of the internal combustion engine.

FIG. 3 illustrates more specifically the position and configuration of the internal passages for both air and fuel contained in the second portion 40 of housing 32. Air supply port 46 communicates with an air passage 46' which extends laterally into the housing and terminates generally adjacent a central axis as will be described more fully below. Fuel drain port 44 connects with a generally L-shaped drain branch 44' including a generally horizontal leg 48 extending between the drain port 44 and the center axis of the housing. A second leg (not illustrated) of the drain branch 44' extends generally vertically from the inner end of leg 48 to the bottom surface of the second portion 40 of the burner housing 32. Fuel supplied to the burner via conduit 24 (FIG. 1) enters the burner assembly through fuel supply port 50. A generally L-shaped fuel supply branch 52 communicates with fuel supply port 50 and includes a generally horizontal leg 54 and a generally vertical leg 56 connected with the horizontal leg 54 at a point along the central axis of the burner housing.

Referring now to FIG. 4, the specific flow path of fuel within the burner housing can be more readily understood. FIG. 4 constitutes a cross-sectional view of the burner housing and shows more clearly the configuration of cylindrical wall portion 34. The interior of portion 34 defines the combustion chamber 58 into which atomized fuel is sprayed by a fuel nozzle 60 in accordance with a predetermined spray pattern designed to compliment the shape of the combustion chamber 58 in a manner to form a toroidal pattern of recirculating combustion gases as described more fully in the co-pending application referred to above, Ser. No. 959,650, assigned to the same assignee as the subject invention. Portion 34 includes an end wall 64 arranged generally perpendicularly with respect to the central axis of the burner housing. Within wall 62 is a combustion gas exit port 62 positioned opposite the fuel nozzle 60. The size of the combustion gas exit port 62, the shape of the atomized fuel spray pattern formed by nozzle 60 and the diameter of the combustion chamber 58 are all carefully controlled in accordance with the teachings contained in the above cited co-pending application to produce an extremely stable and reliable combustion flame which is relatively insensitive to cross currents and/or pressure variations in the intake manifold.

FIG. 4 clearly illustrates a generally circular fuel flow cavity 66 contained in the bottom side of the second portion 40 of the burner housing 32. The circular flow cavity 66 communicates with the vertical leg 56 of fuel supply branch 52 and also communicates with a vertical leg 68 of drain branch 44'. A vertically oriented central branch 70 extends between flow cavity 66 and a generally horizontally oriented supply cavity 72 communicating directly with nozzle 60. It can now be seen that fuel is supplied to the burner nozzle 60 through a fuel supply passage formed by fuel supply branch 52, central fuel flow cavity 66, central branch 70 and supply cavity 72. That portion of the fuel received through fuel supply port 50 which is not atomized by nozzle 60 is drained away from the fuel flow cavity 66 by the drain branch 44'. Although not specifically illustrated in FIG. 4, air provided to the burner housing through air supply port 44 and air passage 46' communicates with an air supply cavity 74 to provide air to the fuel nozzle 60.

FIG. 4 also illustrates a valve assembly 76 for controlling the flow of fuel through the burner housing including a valve member 78 movable between a first position in which fuel flow is cut off between legs 56 and 68 and the central branch 70 and a second position, illustrated in FIG. 4, in which fuel is allowed to flow in the pattern illustrated by arrows 80. A solenoid operator 82 connected with valve member 78 is used to move the valve member 78 between the first and second positions in response to electrical signal provided over wires 84.

To insure fast and reliable operation of the fuel burner illustrated in FIG. 4, even at low ambient temperatures, heat generating means 42 is positioned partially in a cavity 86, illustrated in dash lines, in a position as close as possible to the fuel flow passage formed by fuel supply branch 52 (including legs 54, 56), flow cavity 66, central branch 70 and supply cavity 72. Heat generating means 42 may take the form of a glow plug 87 which will be described more fully below. It should be noted that all these passages are arranged as close as possible to the heat generating means 42 while at the same time providing sufficient thickness to the intervening portions of the burner housing so as to insure sufficient strength to the resulting housing structure. As is evident from FIG. 4, central branch 70, leg 68 and leg 56 are all arranged in parallel vertical orientation in a single plane parallel generally to the longitudinal axis of glow plug 87. Leg 54 and flow cavity 66 are arranged above and below, respectively, glow plug 87 in an orientation which is generally perpendicular to the vertical plane in which plane 70 and legs 68 and 56 are located. By this arrangement, it is apparent that the flow path of fuel through housing 32 is such that fuel flows on three separate sides of the glow plug to maximize the heat transfer capabilities of the glow plug.

Housing 32 will normally be formed of cast metallic material, such as cast iron, having a high heat conducting capacity between cavity 86 and the fuel passage contained within the burner housing. For reasons which will be further explained hereinbelow, the heat generating means 42 and cavity 86 are formed to insure metal-to-metal contact for further increasing the heat transfer characteristics of the fuel burner assembly. In particular, the heat generating means 42 may be a standard type glow plug 87 such as CHAMPION AG-41 sold by Champion Spark Plug Co., 900 Upton Avenue, Toledo, Ohio, which has a rated output of 95 watts at an 11 volt level of energization. This type of plug (illustrated in FIG. 5) has a heating coil encased by a metallic sheath 88 normally adapted for transfer of heat into the surrounding air. As is apparent from FIGS. 4 and 5, glow plug 87 also includes a threaded portion 83 for engaging an internally threaded extension of cavity 86 formed by a threaded nut 81 affixed to housing 32 in some manner such as by welding. A hexagonal head 85 integral with the glow plug may be used to allow the plug to be tightened into place by a wrench. By causing the metal sheath 88 to be in metal-to-metal contact with the burner housing, the level of energization of the glow plug may be substantially increased over the rated level without fear of the sheath 88 reaching an excessively high temperature which would result in premature failure of the glow plug. Electrical power supply 89 is connected with glow plug 87 and is designed to energize the glow plug at a predetermined level such as 24 volts for a predetermined length of time such as 30 or 60 seconds.

Figure 6:
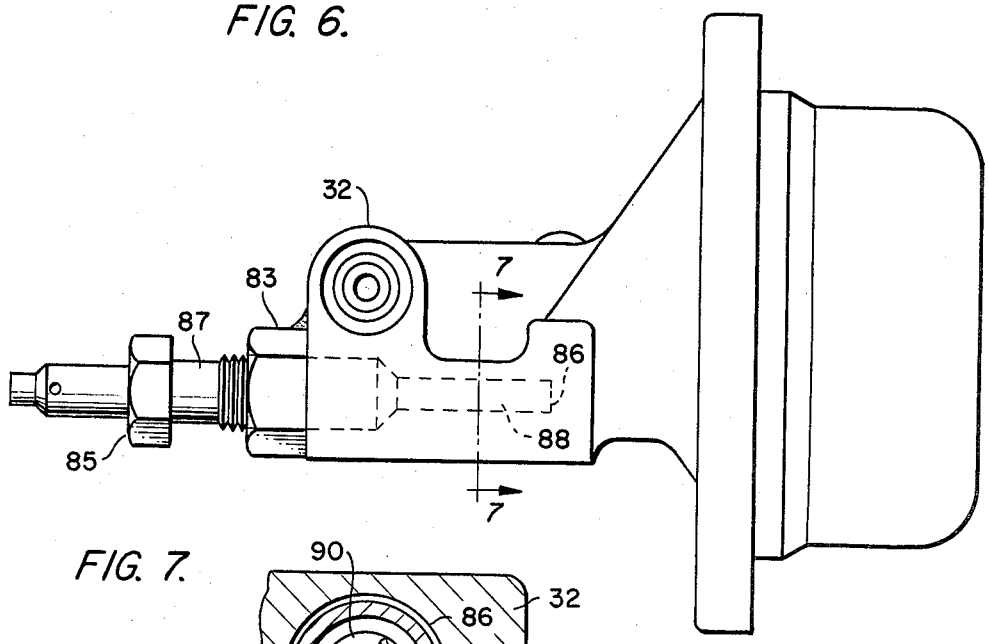
FIG. 6 is a side elevational view of the fuel burner illustrated in FIGS. 1-4.
Figure 7:
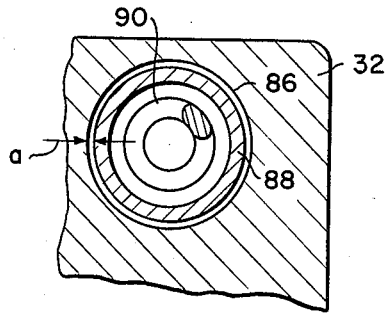
FIG. 7 is a cutaway, partial cross sectional view of the fuel burner taken along lines 7—7 of FIG. 6.

For a more specific understanding of the glow plug mounting and operating concepts associated with the subject invention, reference is now made to FIGS. 6 and 7 wherein the glow plug of FIG. 5 is illustrated in a position in which it is mounted in the burner housing 32 such that the metal sheath 88 is received within cavity 86. As is more clearly illustrated in the enlarged, cross-sectional view of FIG. 7, metal sheath 88 is formed with an outer diameter slightly less than the inner diameter of cavity 86. This size differential provides a clearance "a" which is vitally important during the assembly of the glow plug 87 in the burner housing. In particular, the metal sheath 88 of a standard type glow plug designed for metal-to-air heat transfer is not strong enough to withstand the deforming forces to which the sheath would otherwise be subjected if cavity 86 were formed for direct contact with sheath 88 during the assembly process. Clearance "a" is sufficiently small that upon initial energization of the glow plug, the temperature induced expansion of sheath 88 will cause almost immediate metal-to-metal contact with burner housing 32 thereby causing greater heat transfer into the housing and limiting the upper temperature of sheath 88 and the resistive heating element 90 mounted therein. By shaping cavity 86 in the manner described above, it is possible to safely energize glow plug 87 at a voltage level equal to double the rated value of the glow plug. When energized at this level, a dramatic increase is achieved in the speed with which wax crystals, deposited in the fuel flow passage of housing 32, are melted as compared with energization of the same glow plug at its rated value. While achieving this dramatic increase in the heat generating capabilities of the glow plug, damage to the metal sheath 88 during assembly is avoided by providing the clearance "a" referred to above. Without such clearance, sheath 88 would be insufficiently strong to resist deformation during the assembly. The alternative would be a specially designed glow plug structure which would very substantially increase the cost of manufacturing the subject burner assembly.

Figure 8:
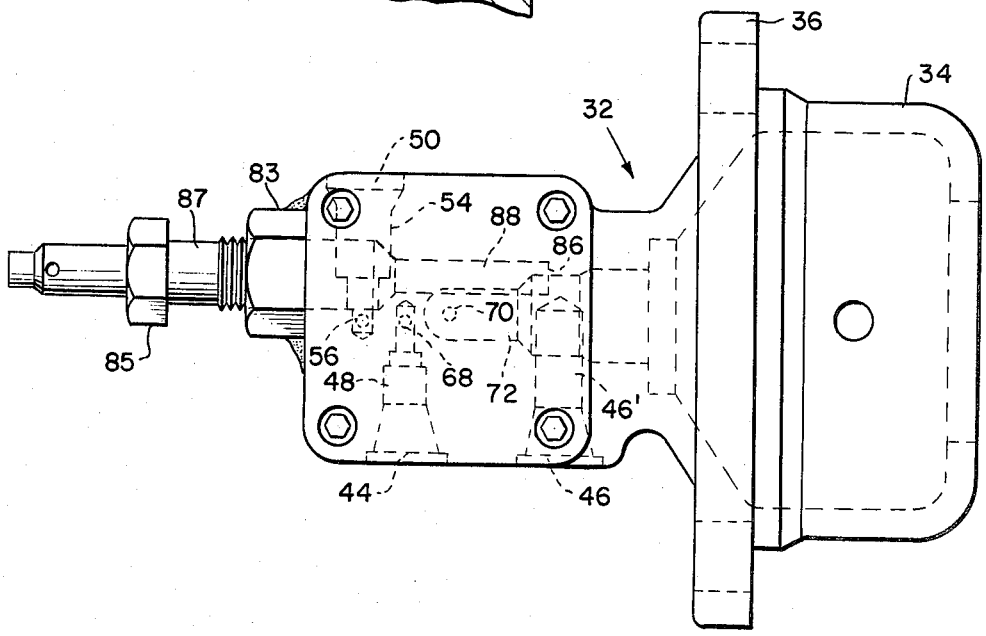
FIG. 8 is a bottom elevational view of the fuel burner illustrated in FIG. 7.

FIG. 8 is referred to merely for the disclosure therein of a bottom elevational view of the burner assembly showing a portion of the fuel and air passages in phantom.

Figure 9:
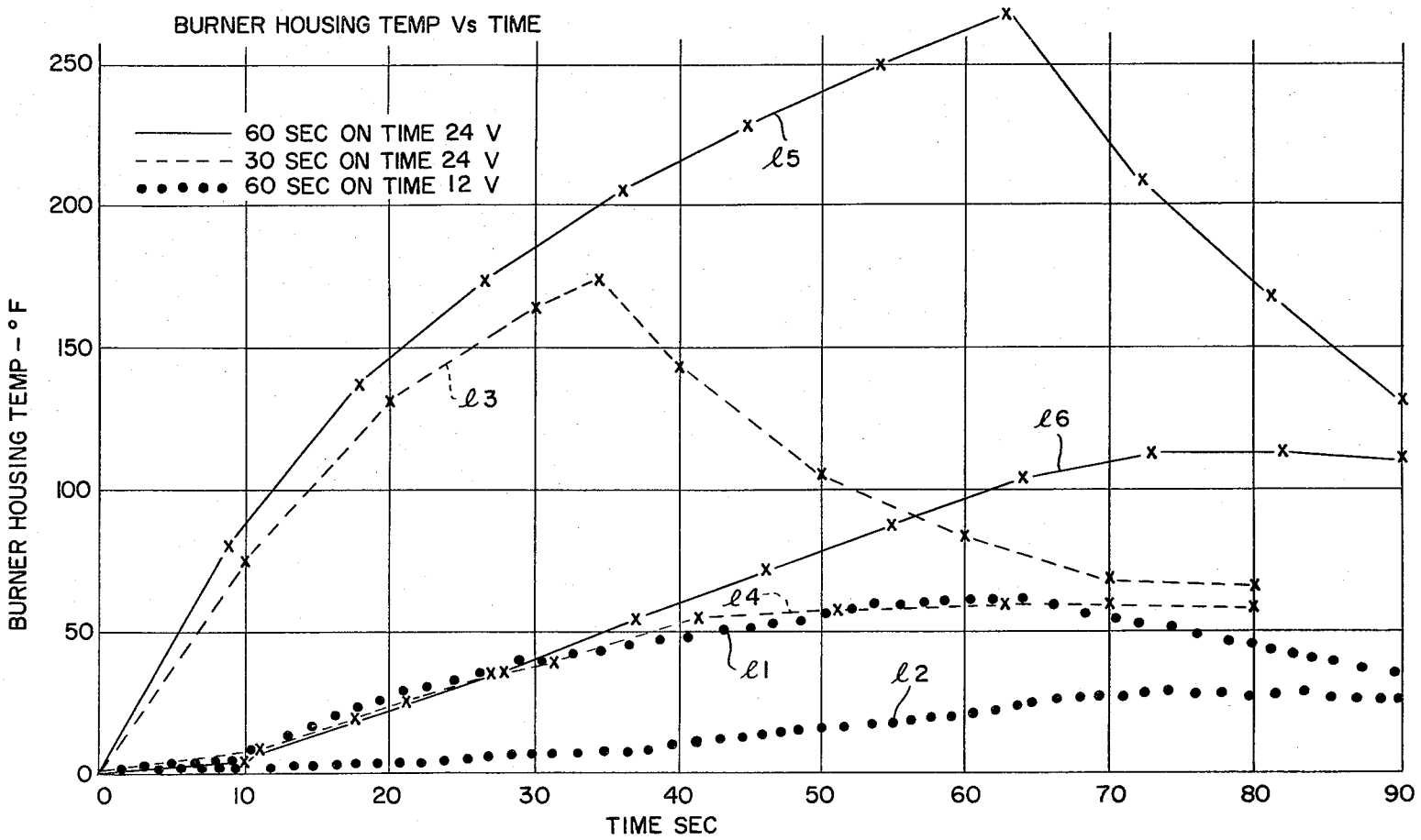
FIG. 9 is a graph for comparing the fuel burner temperature over time at different levels and time periods of electrical energization of the glow plug.

FIG. 9 is a graph showing the relative advantages of doubling the level of energization of the glow plug. In particular the dotted lines 1-1 and 1-2 represent temperature of the hottest and coolest parts of the burner housing when the glow plug is energized for 60 seconds at 12 volts. The short dashed lines 1-3 and 1-4 show the temperatures of the corresponding portions of the burner housing when the glow plug is energized for 30 seconds at 24 volts. Finally, lines 1-5 and 1-6 disclose the burner housing temperatures when the glow plug is energized for 60 seconds at 24 volts. The higher temperatures represented by lines 1-3 through 1-6 as compared with the temperatures represented by lines 1-1 and 1-2 clearly demonstrate the advantages associated with the higher level of electrical energization made possible by the burner housing design described above.

Industrial Applicability

The subject invention has particular utility in providing a source of heat for the intake air of an internal combustion engine. In particular, the disclosed fuel burner is extremely useful in providing quick and reliable starting of turbo-charged internal combustion engines of the compression ignition type. The disclosed burner design also has utility in a wide range of other applications wherein fast and reliable starting, even at low ambient temperatures, are desirable.

We claim:

1. A burner assembly for liquid fuel of a type having a tendency to develop meltable wax deposits at low ambient temperature, comprising (a) fuel burner means for burning the liquid fuel;

(b) a housing connected with said fuel burner means and containing a fuel passage through which fuel flows from a source of fuel toward said fuel burner means and further containing a heat receiving cavity of predetermined size;

(c) heat generating means suitable for radiating heat into ambient air upon electrical energization and having a rated level of electrical energization for designating a maximum safe level of energization when said heat generating means is used to radiate heat into ambient air and being positioned within said heat receiving cavity for generating sufficient heat upon a predetermined level of electrical energization substantially greater than said rated level to melt wax deposits formed in said fuel passage, said heat generating means including an outer heat conducting portion which expands from a first size in which a clearance exists between the interior walls of said heat receiving cavity and said outer heat conducting portion to a second size in which said outer heat conducting portion comes in direct contact with the interior walls of said heat receiving cavity whenever said heat generating means is energized for a predetermined minimum time at said predetermined level; and (d) electrical energization means connected with said heat generating means for supplying said predetermined level of electrical energization to said heat generating means.

2. A burner assembly as defined in claim 1, wherein said predetermined level of electrical energization is approximately double said rated level of electrical energization.

3. A burner assembly as defined in claim 2, wherein said heat generating means has a rated level of approximately 95 watts at 11 volts.

4. A burner assembly as defined in claim 1, wherein said burner means includes a nozzle means for spraying fuel, a supply port means for supplying fuel to said housing and a drain port means for draining away the portion of fuel supplied to said housing by said supply port means which is not sprayed by said nozzle means, said fuel passage including a supply branch extending from said supply port means toward said nozzle means and a drain branch extending between said supply branch and said drain port means.

5. A burner assembly as defined in claim 4, wherein said nozzle means includes a fuel atomizer means for combining the fuel with air and spraying the fuel and air in a predetermined spray pattern, said housing including an air supply port means for supplying air to said housing and containing an air supply passage extending between said nozzle means and said air supply port means.

6. A burner assembly as defined in claim 1, wherein said housing includes material having a high heat conducting capacity positioned between said heat receiving cavity and said fuel passage.

7. A burner assembly for liquid fuel of a type having a tendency to develop meltable wax deposits at low ambient temperature, comprising:

(a) a housing containing a combustion zone and a fuel passage through which fuel flows from a source of fuel toward the combustion zone and further containing a cavity of predetermined size for receiving a source of heat;

(b) heat generating means positioned within said cavity for generating heat upon electrical energization to melt wax deposits formed in said fuel passage;

(c) nozzle means for spraying fuel into the combustion zone;

(d) a supply port means for supplying fuel to said housing; and (e) a drain port means for draining away the portion of fuel supplied to said housing by said supply port means which is not sprayed by said nozzle means; wherein said fuel passage includes a supply branch extending from said supply port means toward said nozzle means and a drain branch extending between said supply branch and said drain port means and further wherein said fuel passage includes a fuel supply cavity formed below said heat receiving cavity and a central branch extending vertically from said fuel supply cavity toward said nozzle means, said supply branch including one supply leg positioned above said heat receiving cavity and extending horizontally inwardly toward the central portion of said housing and a second supply leg extending vertically from said one supply leg toward said fuel supply cavity, said central branch and said second supply leg residing generally in a vertical plane arranged in parallel orientation with respect to the longitudinal axis of said heat receiving cavity.

8. A burner assembly as defined in claim 7, wherein said drain branch includes a first leg vertically extending from said fuel supply cavity and a second leg horizontally extending from said first leg toward said drain port means, said first leg being positioned within said vertical plane defined by said central branch and said second supply leg.

9. An intake air heating device for heating the intake air passing through the intake manifold of an internal combustion engine, comprising (a) a housing containing a combustion chamber having a combustion gas exit port, a fuel passage through which fuel flows from a source of fuel toward said combustion chamber, and a heat receiving cavity of predetermined size, said housing including mounting means for mounting said housing on an intake manifold in a position to cause the combustion gas exit port to communicate with the interior of the intake manifold;

(b) heat generating means suitable for radiating heat into ambient air upon electrical energization and having a rated level of electrical energization for designating a maximum safe level of energization when said heat generating means is used to radiate heat into ambient air and being positioned within said heat receiving cavity for generating sufficient heat upon a predetermined level of electrical energization substantially greater than said rated level to melt wax deposits formed in said fuel passage, said heat generating means including an outer heat conducting portion which expands from a first size in which a clearance exists between said heat receiving cavity and said outer heat conducting portion to a second size in which said outer heat conducting portion comes in direct contact with the interior walls of said heat receiving cavity whenever said heat generating means is energized for a predetermined minimum time at said predetermined level; and (c) electrical energization means connected with said heat generating means for supplying said predetermined level of electrical energization to said heat generating means.

10. A burner assembly as defined in claim 9, wherein said electrical energization means is connected with said heat generating means for a predetermined time commencing upon start-up of the internal combustion engine, said predetermined level of electrical energization being approximately double said rated level of electrical energization.

11. A burner assembly as defined in claim 9, wherein said housing includes material having a high heat conducting capacity positioned between said heat receiving cavity and said fuel passage.

12. A burner assembly as defined in claim 9, further including a nozzle means for spraying fuel into said combustion chamber, a supply port means for supplying fuel to said housing and a drain port means for draining away the portion of fuel supplied to said housing by said supply port means which is not sprayed by said nozzle means, said fuel passage including a supply branch extending between said supply port means and said nozzle means and a drain branch extending between said supply branch and said drain port means.

13. A burner assembly as defined in claim 12, wherein said nozzle means includes a fuel atomizer means for combining the fuel with air and spraying the fuel and air in a predetermined spray pattern, said housing including an air supply port means for supplying air to said housing and containing an air supply passage extending between said nozzle means and said air supply port means.

14. A burner assembly as defined in claim 12, further including valve means for controlling the flow of fuel through said fuel passage, said valve means including a valve member movable between a first position in which both said supply and drain branches are blocked and a second position in which fuel may flow through said supply and drain branches.

15. A burner assembly as defined in claim 14, further including a valve operator means for responding to electrical energization to move said valve element between said first and second positions.

16. A burner assembly as defined in claim 12, wherein said fuel passage includes a fuel supply cavity formed below said heat receiving cavity and a central branch extending vertically from said fuel supply cavity toward said nozzle, said supply branch including one supply leg positioned above said heat receiving cavity and extending horizontally inwardly toward the central portion of said housing and a second supply leg extending vertically from said one supply leg toward said fuel supply cavity, said central branch and said second supply leg residing generally in a vertical plane arranged in parallel orientation with respect to the longitudinal axis of said heat receiving cavity.

17. A burner assembly as defined in claim 16, wherein said drain branch includes a first leg vertically extending from said supply cavity and a second leg horizontally extending from said first leg toward said drain port means, said first leg being positioned within said vertical plane defined by said central branch and said second supply leg.

* * * * *